US005927298A

United States Patent [19]

Tiram

[11] Patent Number: 5,927,298

[45] **Date of Patent: *Jul. 27, 1999**

[54] COMBINATION SHAVING DEVICE AND MIRROR

[75] Inventor: Aaron Tiram, Chicago, Ill.

[73] Assignee: Ecoco, Inc., Chicago, Ill.

[ * ] Notice: This patent is subject to a terminal disclaimer.

[21] Appl. No.: 08/925,204

[22] Filed: Sep. 8, 1997

Related U.S. Application Data

[63] Continuation-in-part of application No. 08/881,976, Jun. 25, 1997.

[51] Int. Cl.[6] ..... A45D 27/22; A45D 42/08

[52] U.S. Cl. ..... 132/291; 132/292; 132/289; 132/316; 30/34.05; 30/537

[58] Field of Search ..... 132/291, 292, 132/289, 316; 30/34.05, 123, 526, 537; D28/44, 45, 48

[56] References Cited

U.S. PATENT DOCUMENTS

| | | | |
|---|---|---|---|
| 1,676,183 | 7/1928 | Garfunkle | 30/34.05 |
| 2,341,743 | 2/1944 | Rothner | 30/34.05 |
| 3,043,996 | 7/1962 | Hartwig et al. | 30/34.05 |
| 4,733,468 | 3/1988 | Zadro | 30/34.05 |
| 4,888,868 | 12/1989 | Pritchard | 132/289 |
| 5,692,529 | 12/1997 | Fekete | 132/291 |

*Primary Examiner*—Gene Mancene
*Assistant Examiner*—Pedro Philogene
*Attorney, Agent, or Firm*—Laff, Whitesel, Conte & Saret, Ltd.

[57] ABSTRACT

A shaving device having a body member with an integrally formed cutting head and a permanently or removably attached mirror, whereby a user can view the area being shaved in the mirror. The shaving device may be electric or a straight edge razor.

27 Claims, 5 Drawing Sheets

FIG. 1
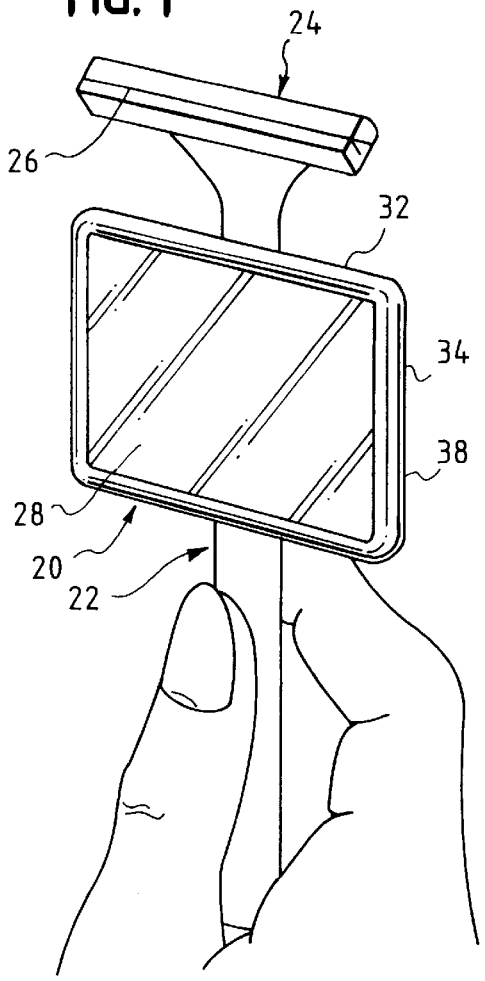
FIG. 2
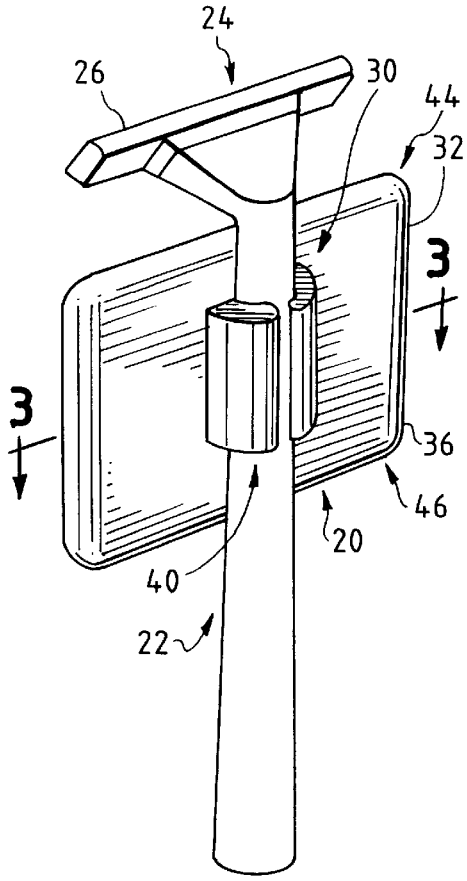
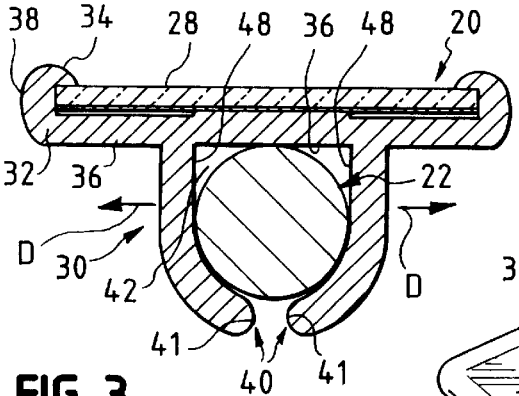
FIG. 3
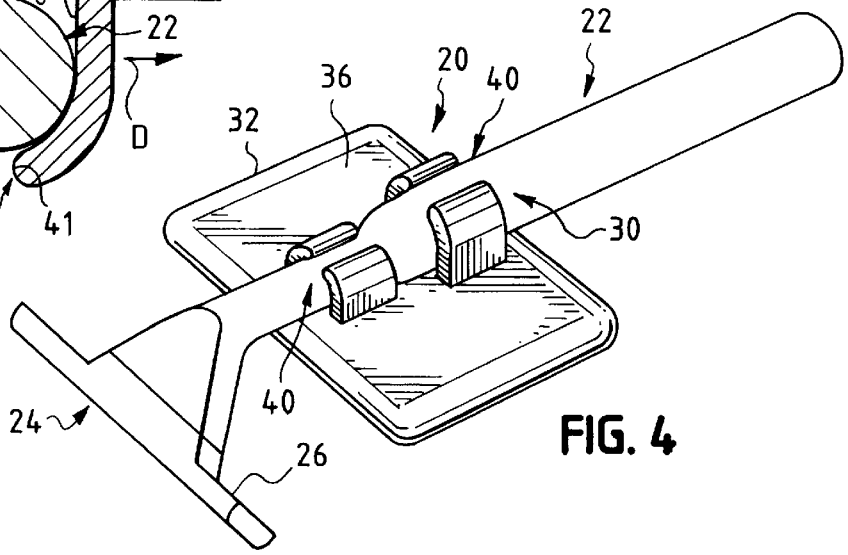
FIG. 4

FIG. 12
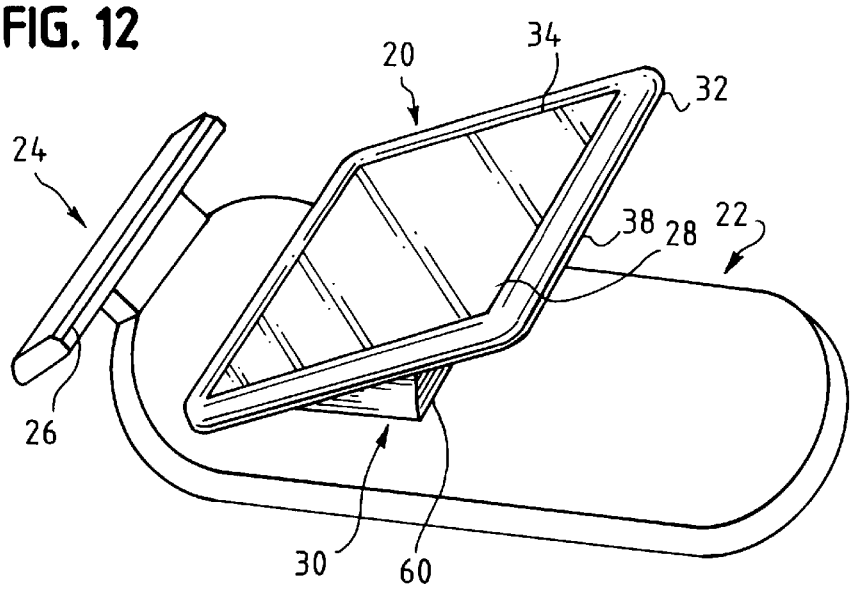
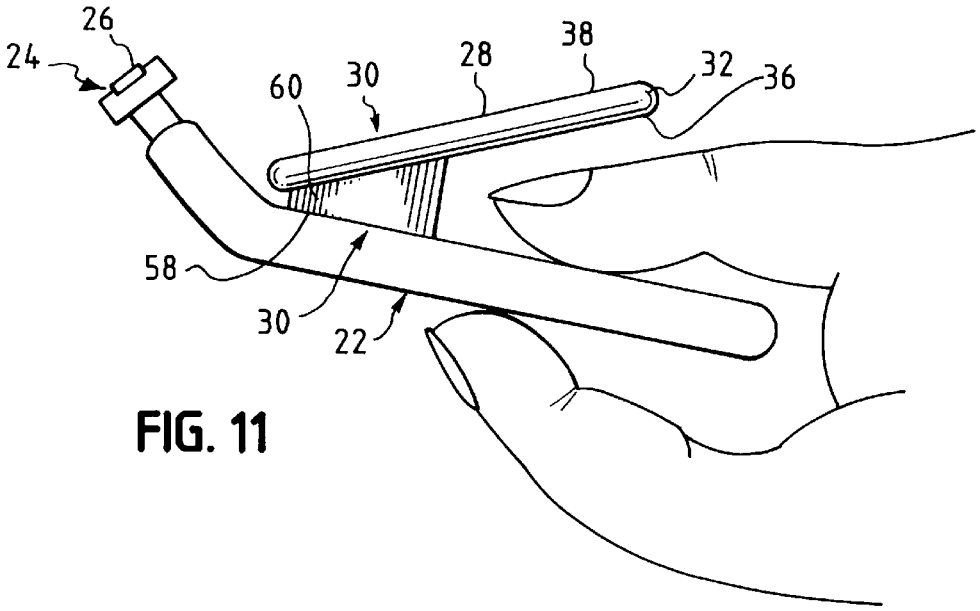
FIG. 11
FIG. 13
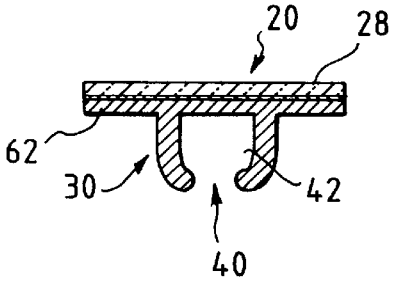
FIG. 14
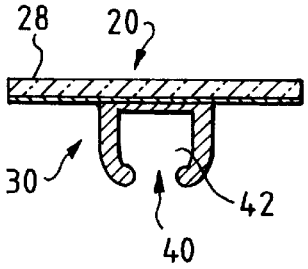

COMBINATION SHAVING DEVICE AND MIRROR

This is a continuation-in-part of application Ser. No. 08/881,976, filed Jun. 25, 1997, pending. This invention relates to shaving devices. More particularly, this invention relates to shaving devices with permanently or removably attached mirrors.

FIELD OF THE INVENTION

BACKGROUND OF THE INVENTION

Electric and straight edge shaving devices are used by both men and women to remove unwanted hair. These devices, which typically include hand grip portions with integrally formed cutting heads on one end, are ideally used with mirrors for viewing the shaving area to ensure complete hair removal. However, because shaving is frequently performed in locations without mirrors, such as in the workplace, car or on public transportation, complete hair removal is often not practical.

In many instances, however, mirrors are available for shaving. Notwithstanding this, because the mirrors often are attached to walls, doors or other permanent fixtures, they cannot be positioned adjacent the shaving areas for viewing which limits their usefulness. A similar problem also applies to portable mirrors in that the positioning of the mirrors adjacent the shaving areas is usually possible but is generally difficult. This is particularly evident when shaving the intimate underarm and bikini areas on women. Typically, the mirrors are hand held adjacent the shaving areas which leaves the user with only one hand for shaving. This is generally unsatisfactory, particularly for intimate areas, such as the bikini area, where often two hands are needed for shaving.

Thus, shaving devices which include mirrors have been introduced in an effort to eliminate some of the above-described problems. These known devices typically include mirrors which are attached to the shaving cases of electric shavers or which are otherwise separate from but included with the shaving device. While these separate mirrors are adequate in some instances, there are problems associated with their use. For example, the mirror cases are generally not waterproof, and as a result they are unsuitable for the shower or bath. Furthermore, because the mirror cases are generally cumbersome, they are difficult to manipulate close to the shaving area, especially intimate areas. In addition, the mirror cases and other separate mirrors must be hand held which leaves only one hand for shaving. As previously described, this creates problems especially when shaving intimate areas.

Accordingly, an object of the present invention is to provide a shaving device that includes an attached mirror.

It is another object of the present invention to provide a shaving device with a mirror that is small and unobtrusive.

It is another object of the present invention to provide a shaving device with a mirror that is held with the same hand as the shaving device.

It is another object of the present invention to provide a shaving device with a mirror that is waterproof.

It is another object of the present invention to provide a shaving device with a clip-on mirror which may be adjustably angled for optimal viewing of the shaving area.

It is yet another object of the present invention to provide a shaving device with a mirror that is easy to assemble and store.

Other objects and advantages of the invention will appear hereinafter.

SUMMARY OF THE INVENTION

The present invention, in a preferred embodiment, accomplishes the foregoing objects by providing a shaving device of the type having a body member or grip portion with a cutting head at one end and a mirror attached to the body member.

In one embodiment, the mirror is removably attached to a frame having a front edge, a back and at least one side. The attachment means, which are integrally formed with the back of the frame, comprise at least one pair of opposed members which project from and form a u-shaped channel with the frame back at their point of attachment to the frame. The opposed members releasably engage the body member of a straight edge razor when it is positioned between the members and inside the channel. The opposed members are adapted to grip body members having circumferences of varying sizes and shapes.

The opposed members may be resilient or, alternatively, may include resilient tab portions or other protuberances for retaining the body member of the shaving device within the channel and between the opposed members during use. The resilient members and tab portions preferably terminate with inwardly projecting tips.

Two or more adjacent pairs of opposed members are used to engage body members which are stepped or of varying thicknesses. In addition, the back between one or more pairs of opposed members may be optionally tapered to angle the mirror towards the cutting head of the shaving device for optimal viewing of the shaving area.

In another embodiment, the frame is rectangular or square in shape, with the attachment means being affixed to opposing sides of the frame. The attachment means therein comprise an adjustable tension strap and are adapted for use on an electric shaving device.

In a further embodiment, the attachment means are pivotally mounted to the frame for movably adjusting the angle of the mirror relative to the cutting head of the shaving device. The attachment means are mounted to the body members by any suitable fastening mechanism.

In yet another embodiment, the attachment means are Velcro, foam tape or any type of adhesive. An angled wedge is optionally positioned between the back of the mirror and the aforementioned attachment means to adapt to special razor designs such as, for example, razors with angled cutting heads. The angled wedge may also be used with conventional straight edge razors for angling the mirror towards the cutting head.

In two other embodiments, the mirror is attached to a backing, with the attachment means being affixed to the backing. Alternatively, the mirror does not include a backing and the attachment means are affixed directly to the mirror. The attachment means, which have been described in the above embodiments relating to a straight edge razor, are also applicable to these two embodiments.

In another embodiment, the mirror is integrated within the body member of the shaving device. For example, the mirror may be mounted within a recess in the surface of the body member.

The above, as well as other objects and advantages of the invention, will become apparent from the following detailed description of the preferred embodiments, reference being made to the accompanying drawings.

BRIEF DESCRIPTION OF THE DRAWINGS

FIG. 1 is a front perspective view of a preferred embodiment of the invention.

FIG. 2 is a rear perspective view of the embodiment of FIG. 1.

FIG. 3 is a cross-sectional view taken along lines 3—3 of FIG. 2.

FIG. 4 is a perspective view of another embodiment of the invention.

FIG. 11 is a perspective view of another embodiment of the invention.

FIG. 12 is a side view of the embodiment of FIG. 11.

FIG. 13 is a cross-sectional view of another embodiment of the invention.

FIG. 14 is a cross-sectional view of another embodiment of the invention.

DETAILED DESCRIPTION OF THE INVENTION

Figure 5:
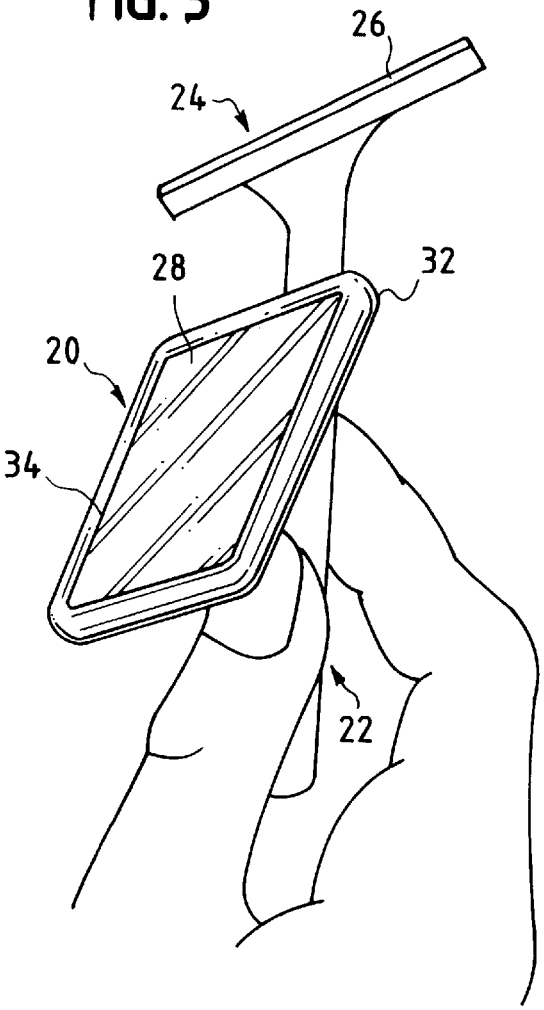
FIG. 5 is a front perspective view of another embodiment of the invention.

Generally referring to FIGS. 1–16, the invention provides a shaving device comprising a body member 22, a head member 24, and a mirror 28 permanently or removably attached to body member 22. The head member is integrally formed with one end of the body member and includes a cutting mechanism 26. Where the mirror is removably attached, a clip-on mirror assembly, denoted by the numerals 20 and 20', includes a mirror 28 and attachment means 30 for removably securing mirror 28 to the shaving device. The shaving device may be electrically powered (FIG. 9) or a straight edge razor (FIGS. 1–6, 10–12, 15–16).

In a first embodiment, mirror 28 is attached to a frame 32 having a front edge 34, a back 36 and at least one side 38 (FIGS. 1–3). Attachment means 30, which are integrally formed with back 36 of frame 32, include at least one pair of opposed members 40 which project from and form a u-shaped channel 42 with back 36 of frame 32 (FIG. 3). Opposed members 40 releasably engage body member 22 of a straight edge razor when body member 22 is positioned between the members and inside channel 42 (FIGS. 2, 3). Opposed members 40 are adapted to grip body members having circumferences of varying sizes and shapes. Two or more adjacent pairs of opposed members are used to engage body members which are stepped or of varying thicknesses (FIG. 4).

Figure 6:
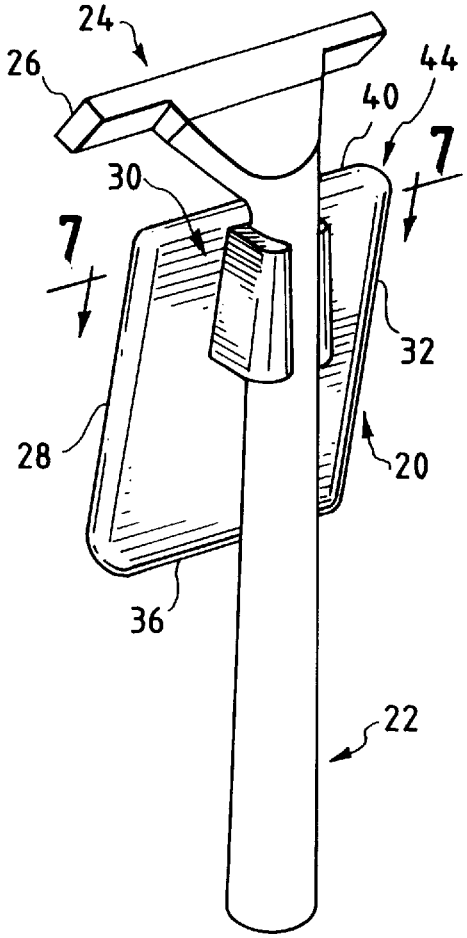
FIG. 6 is a rear perspective view of the embodiment of FIG. 5.
Figure 7:
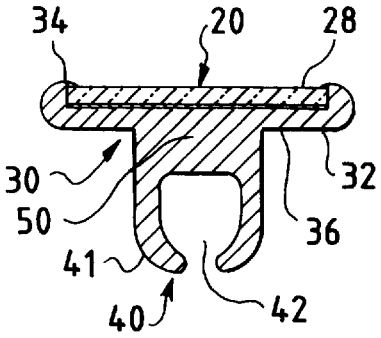
FIG. 7 is a cross-sectional view taken along lines 7—7 of FIG. 6.
Figure 8:
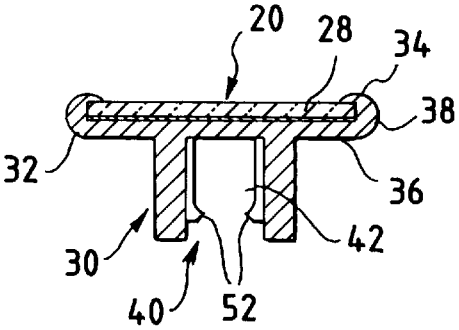
FIG. 8 is a cross-sectional view of another embodiment of the invention.

Opposed members 40 longitudinally extend over back 36 from adjacent top portion 44 to adjacent bottom portion 46 of frame 32 (FIG. 2). Opposed members 40 may vary in length, but are generally parallel to one another and the sides of the frame. Opposed members 40 include inside walls 48 which, together with back 36 of frame 32 located between walls 48, form channel 42 (FIG. 3). The bottom (or back of frame 32 between opposed members 40) of channel 42 may be optionally tapered (as indicated by numeral 50) to angle the mirror towards the cutting head of the shaving device for optimal viewing of the shaving area (FIGS. 5–7). Opposed members 40 are preferably located adjacent top portion 44 if the bottom of channel 42 is tapered (FIG. 6).

Opposed members 40 may be resilient and preferably terminate with inwardly projecting tips 41 (FIG. 3, 7). Alternatively, opposed members 40 are rigid but include resilient tabs (FIG. 8), also with inwardly projecting tips 52, for retaining body member 22 within channel 42 between opposed members 40, as is described in greater detail hereinafter. Opposed members 40 may also include other resilient protuberances (not shown) for retaining the body members within the channels.

Figure 9:
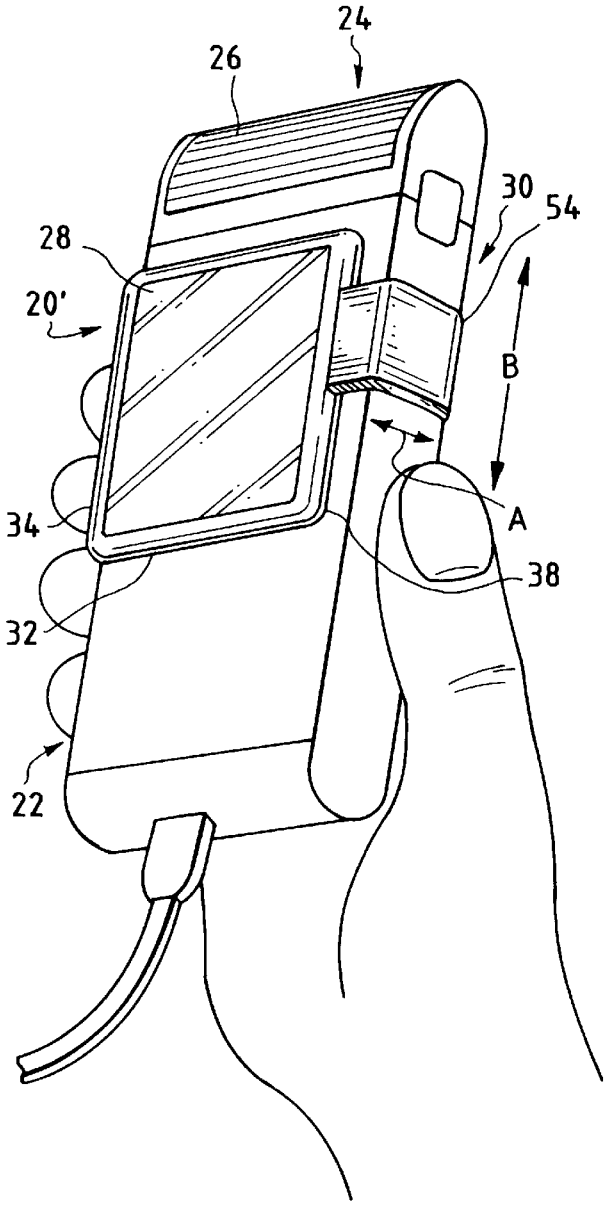
FIG. 9 is a perspective view of another embodiment of the invention.
Figure 10:
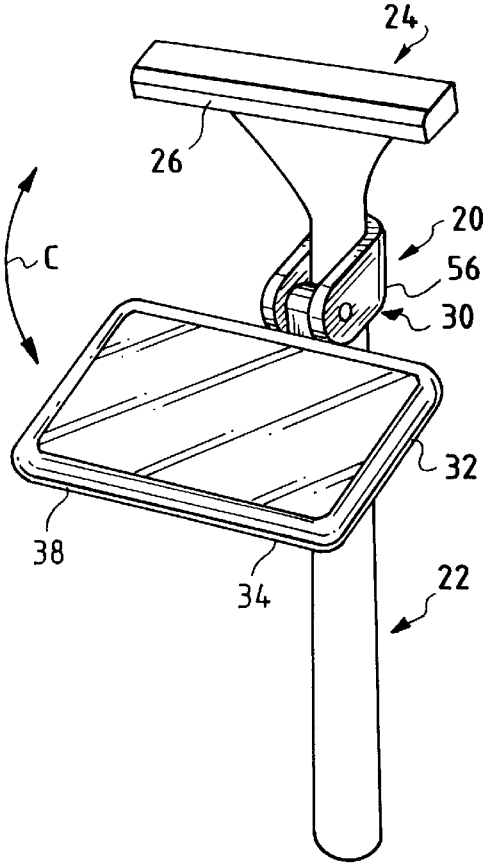
FIG. 10 is a perspective view of another embodiment of the invention.

In another embodiment, frame 32 is rectangular or square in shape, with attachment means 30 being affixed to opposing sides of the frame. Here, the attachment means comprise an adjustable tension strap 54 which is adapted for use on an electric shaving device (FIG. 9). Strap 54 may be laterally adjusted to tighten or loosen the clip-on mirror (as indicated by arrows A) or longitudinally adjusted to move the clip-on mirror up or down the body member (as indicated by arrows B).

In another embodiment, attachment means 30 are pivotally mounted to frame 32 to movably adjust the angle of the mirror relative to the cutting head of the shaving device (as indicated by arrows C in FIG. 10) for optimal viewing of the shaving area, and further for providing finger grasp clearance. The attachment means, which may be mounted to the body members by any suitable fastening mechanism, generally comprises a clasp 56. The mirror may be folded against the body member for storage.

In another embodiment, attachment means 30 are Velcro (not shown), pressure sensitive foam tape 58 (FIG. 12) or any type of adhesive. An angled wedge 60 is optionally positioned between the back of the mirror and the attachment means to adapt to special razor designs such as, for example, razors with angled cutting heads (FIGS. 11, 12). The angled wedge may also be used with conventional straight edge razors for angling the mirror towards the cutting head.

In another embodiment, mirror 28 is attached to a backing 62 with attachment means 30 being affixed to the backing (FIG. 13). Alternatively, mirror 28 does not include a backing and attachment means 30 are affixed directly to the back of mirror 28 (FIG. 14). The attachment means, which have been described in the embodiments above relating to straight edge razors, are also applicable to these embodiments.

Figure 15:
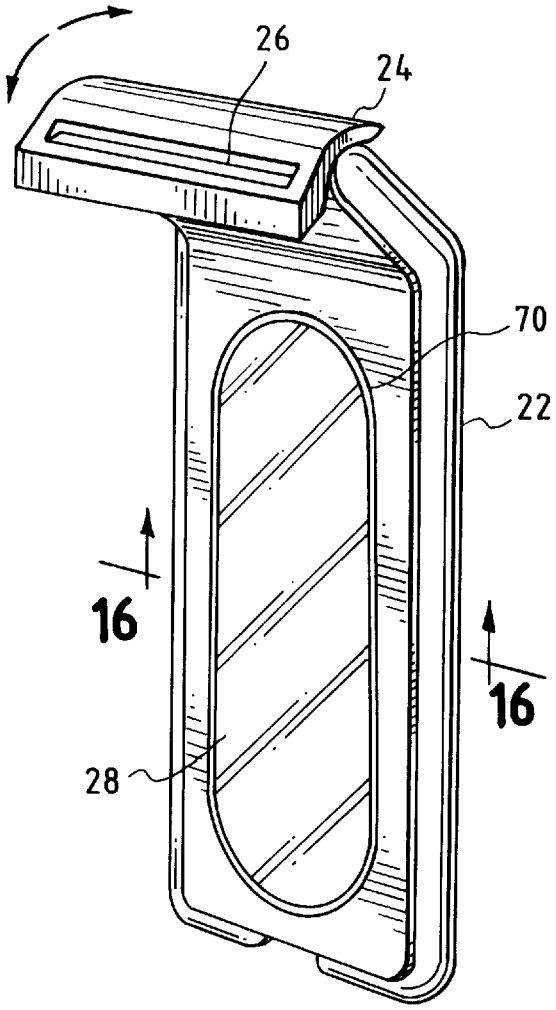
FIG. 15 is a perspective view of another embodiment of the invention.
Figure 16:
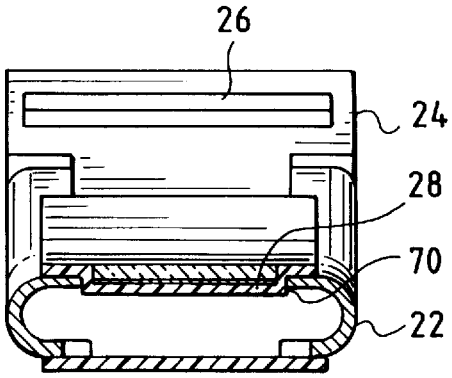
FIG. 16 is a cross-sectional view taken along lines 16—16 of FIG. 15.

In another embodiment, the mirror is integrated within the body member of the shaving device. For example, as shown in FIGS. 15 and 16, mirror 28 may be mounted within a recess 70 in body member 22. In a preferred embodiment, the surface of mirror 28 is flush with that of body member 22.

In each of the described embodiments, mirror 28 is generally rectangular in shape and is preferably mounted horizontally (or is with its length perpendicular) onto or within body member 22 so that most of the body member is available for gripping. Mirror 28 is positioned in close proximity to, or within, body member 22 and is parallel to or angled with the body member. In addition, mirror 28 may be attached to the front or back of the body member according to need and may include a magnifying portion. The mirror 28 is retained in the frame 32 by sonic welding, secondary snap-ons, or other suitable means.

In use, mirror 28 is clipped onto body member 22 of a straight edge razor by moving opposed members 40 into forcible contact with the body member which causes the resilient opposed members, tabs or other protuberances to be outwardly deflected, as indicated by the arrows D in FIG. 3. As the opposed members are outwardly deflected, body member 22 passes into channel 42 wherein it is securely held in place by tips 41, tabs 52, or other protuberances. Once body member 22 is secured within the channel, opposed members 40 return back to their original upright position (FIG. 3). Removal of body member 22 from channel 42 involves the reverse of the above-described insertion process.

Mirror 28 is attached to body member 22 of an electric shaving device by placing the adjustable tension strap over the body member. Alternatively, the mirror may be attached directly to the back or front of the body member of the electric shaving device by any suitable attachment means.

The shaving device with attached clip-on mirror assembly 20 is held with one hand during use. In the embodiments in which mirror 28 is adjustable, the mirror may be directed towards or away from the cutting head as needed for viewing the shaving area.

The material from which mirror frame 32, backing 62, and attachment means 30 of clip-on mirror assembly 20 are constructed is preferably plastic but may be any suitable lightweight material. Moreover, clip-on mirror assembly 20 has not been described in terms of approximate measurements, as it should be understood that the dimensions of the clip-on mirror may vary according to need.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. A mirror for a shaving device of the type having a body member with an integrally formed cutting head at one end, said clip-on mirror comprising:

a mirror; and clip means for removably attaching said mirror to the shaving device.

2. The mirror of claim 1 wherein said mirror is attached to a frame having a front edge, a back and at least one side.

3. The mirror of claim 2 wherein said clip means are integrally formed with the back of the frame.

4. The mirror of claim 3 wherein said integral clip means comprise at least one pair of opposed members projecting from and defining a U-shaped channel with the back of the frame, said members releasably engaging the body member of the shaving device when said body member is inserted into said channel.

5. The mirror of claim 4 wherein said opposed members are resilient.

6. The mirror of claim 4 wherein each of said opposed members terminate with an inwardly projecting tip.

7. The mirror of claim 4 wherein said opposed members releasably engage the body member regardless of the size and shape of the body member circumference.

8. The mirror of claim 4 wherein the back between said opposed members is tapered for angling said mirror towards the cutting head of the shaving device.

9. The mirror of claim 2 wherein an angled wedge is positioned between said back of said mirror and said clip means for angling said mirror towards the cutting head of the shaving device.

10. The mirror of claim 4 wherein said integral clip means comprise two adjacent pairs of opposed members for engaging a body member of varying thickness.

11. The mirror of claim 2 wherein said frame includes two opposing sides, with said clip means being affixed to the sides of the frame.

12. The mirror of claim 1 wherein said mirror is attached to a backing, with said clip means being affixed to the backing.

13. The mirror of claim 1 wherein said clip means are affixed directly to the mirror.

14. An assembly for shaving comprising:

a shaving device having a body member with an integrally formed cutting head at one end;

a mirror; and means for removably attaching said mirror to said body member.

15. The assembly of claim 14 wherein further comprising a support for holding said mirror.

16. The assembly of claim 15 wherein said support is a frame, with said attachment means being affixed to the frame.

17. The assembly of claim 15 wherein said support is a backing, with said attachment means being affixed to said backing.

18. The assembly of claim 14 wherein said attachment means are resilient.

19. A mirror for a shaving device of the type having a body member with an integrally formed cutting head at one end, said clip-on mirror comprising:

a mirror;

a mirror support; and a clip for removably attaching said mirror to the shaving device, said clip being affixed to said mirror.

20. The mirror of claim 19 wherein said clip is resilient.

21. A shaving device comprising:

body member;

a cutting head at one end of the body member;

a mirror attached to the body member, the mirror being angled toward the cutting head whereby a surface being shaved can be viewed in the mirror; and means for movably adjusting the angle of the mirror relative to the cutting head.

22. The shaving device of claim 21 wherein the adjusting means is a pivotal mount attaching the mirror to the body member.

23. The shaving device of claim 21 wherein the mirror comprises a magnifying section.

24. An assembly for shaving comprising:

a shaving device having a body member with an integrally formed cutting head at one end;

a mirror; and means for releasably gripping the body member associated with the mirror.

25. The assembly of claim 24 wherein said means for gripping comprises a clip.

26. The assembly of claim 24 wherein said means for gripping comprises an adhesive.

27. The assembly of claim 24 wherein said means for gripping comprises a strap.

* * * * *